United States Patent [19]

Wang

[11] 4,148,233

[45] Apr. 10, 1979

[54] METHOD OF MAKING A DOUBLE-ENDED HEADING PUNCH

[75] Inventor: William H. Wang, Burlington, Canada

[73] Assignee: Procor Limited, Oakville, Canada

[21] Appl. No.: 891,241

[22] Filed: Mar. 29, 1978

Related U.S. Application Data

[62] Division of Ser. No. 812,928, Jul. 5, 1977, Pat. No. 4,094,185.

[51] Int. Cl.[2] ..... B21K 5/20

[52] U.S. Cl. ..... 76/101 R; 72/474; 72/352

[58] Field of Search ..... 76/101 R, 101 D; 72/474, 475, 360, 352; 10/12 R

[56] References Cited

U.S. PATENT DOCUMENTS

| | | | |
|---|---|---|---|
| 1,449,136 | 3/1923 | Yates | 83/616 |
| 2,638,019 | 5/1953 | Stellin | 76/101 D |
| 3,124,975 | 3/1964 | Lovisek | 76/101 R |
| 3,588,933 | 6/1971 | Shinopulos et al. | 10/12 R |

*Primary Examiner*—Harold D. Whitehead
*Assistant Examiner*—Roscoe V. Parker
*Attorney, Agent, or Firm*—Charles M. Kaplan; Joel E. Siegel

[57] ABSTRACT

A punch for forming a fastener head has a shaped projection at each end and is releasably secured in a holder with one end abutting against a ledge on the inside of the holder and the other end extending beyond the holder. The shaped projections are formed simultaneously by a pair of hobs in one press stroke.

2 Claims, 5 Drawing Figures fig.1.
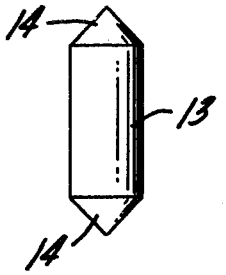
fig.2.
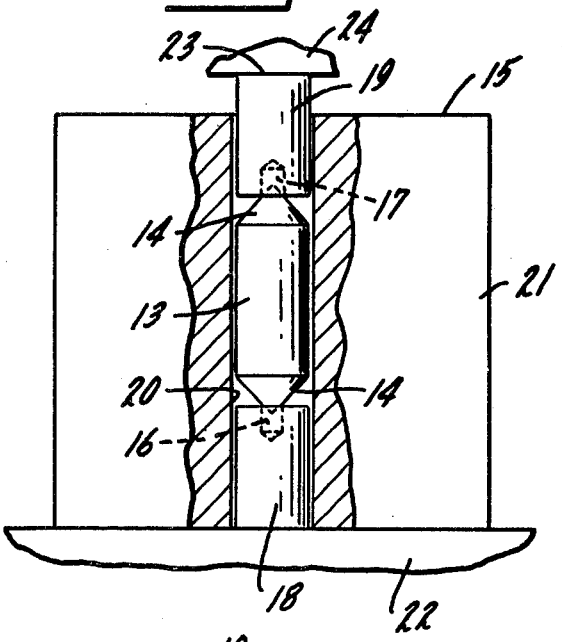
fig.3.
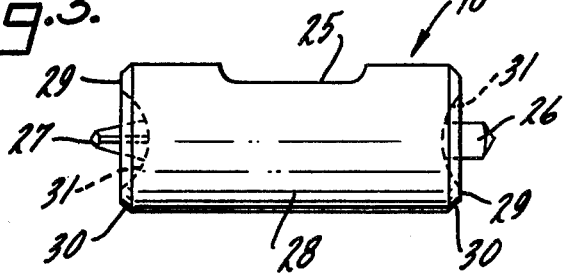
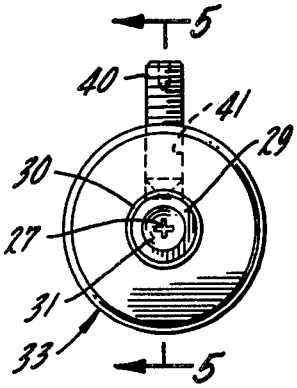
fig.4.
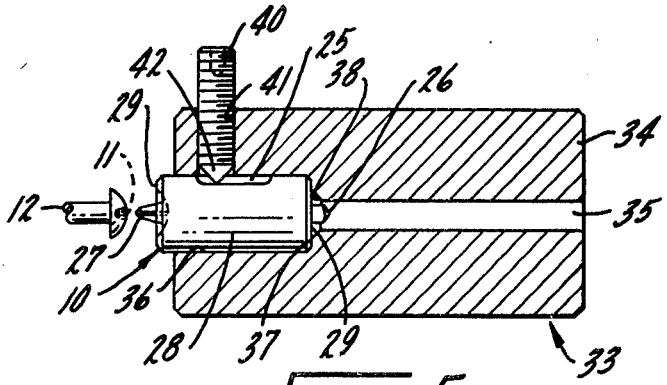
fig.5.

METHOD OF MAKING A DOUBLE-ENDED HEADING PUNCH

This is a division, of application Ser. No. 812,928, filed July 5, 1977, and now U.S. Pat. No. 4,094,185.

BACKGROUND OF THE INVENTION

This invention relates to heading punches that produce a driving-tool engaging recess in the head of a metal blank that may be formed into a fastener, and also to a method of hobbing such punches. The term "recess" is intended to include openings of any shape capable of engaging a tool, such as slots, sockets, holes, etc.

Heading punches having only one recess-forming end are relatively costly to produce, and must be removed and replaced when worn. Using only single-ended punches also necessitates that a large number of individual punches be handled and stored in inventory.

SUMMARY OF THE INVENTION

Accordingly, it is an object of this invention to provide an improved punch and method of making same.

Another object is to provide a double-ended heading punch which can be produced by a single stroke of a hobbing press.

Another object is to provide a punch that forms a driver-receiving recess in the head of a fastener that can be replaced when worn by reversing its ends.

Another object is to provide a double-ended heading punch that is relatively inexpensive to manufacture, store, and replace, is durable, and does not contain defects found in similar prior art tools.

Another object is to provide a method of hobbing double-ended punches that accurately controls the distance separating the ends of such punches.

Another object is to reduce the number of punches which must be stored in a fastener factory.

Another object is to conserve expensive tool steel and energy used to make metal forming punches.

Another object is to provide a relatively efficient and inexpensive method for hobbing double-ended heading punches.

Other objects and advantages will be revealed in the specification and claims, and the scope of the invention will be set forth in the claims.

DESCRIPTION OF THE DRAWING

FIG. 1 is a plan view of a blank that is formed into a punch in accord with this invention.

FIG. 2 is a cross-sectional, schematic representation of a method of hobbing a punch in accord with this invention.

FIG. 3 is a side view of a punch in accord with this invention.

FIG. 4 is an end view of a punch and holder in accord with this invention.

FIG. 5 is a cross-sectional view taken along the line 5—5 in FIG. 4.

DESCRIPTION OF THE INVENTION

The drawing shows a double-ended punch member 10 for producing a driving-tool engaging recess 11 in a metal blank 12 that may, subsequently, for example be rolled between dies into a threaded fastener, such as a wood screw. Recess 11 is formed by a single blow delivered at room temperature.

Punch member 10 is formed from a right circular cylindrical blank or rod 13 of annealed tool steel having identical pointed conical ends 14 centered on its longitudinal centroidal axis. Each pointed end 14 is placed in the forming cavity 16 or 17 of a separate cylindrical hob 18 or 19. In FIG. 2 cavities 16 and 17 are identical and will produce a tool that will punch ROBERTSON square sockets in fastener heads. Rod 13 and hobs 18 and 19 are longitudinally vertically aligned and held in place in a cylindrical hole 20 in a metal support block 21 which is secured to a platen 22 of a hobbing press. One end 23 of hob 19 extends beyond support block 21 and is contacted by another press platen 24. Hobs 18 and 19 are simultaneously pressed against pointed ends 14 until platen 24 engages shoulder 15 of block 21 so as to produce a double-ended punch member 10 by a single press stroke. Hobs 18 and 19 are removed from the ends of punch member 10, which is then heat treated, and the cylindrical surface of rod 13 is centerless ground. Also, a groove 25 may be milled in the side surface of punch member 10.

The resulting double-ended heading punch member 10 shown in FIGS. 3–5 has, for example, a first recess forming punch projection 26 at one end that forms a ROBERTSON square recess in the head of fasteners while rounding the heads of such fasteners, and a second recess forming punch projection 27 at its other end that forms a PHILLIPS recess in the heads of fasteners while rounding the head of such fasteners. Punch member 10 has an enlarged, generally cylindrical, central body portion 28 which terminates in opposed, flat annular shoulders 29 which are chamfered at 30. Each shoulder 29 surrounds a central depression 31 at each end of member 10 in which projections 26 and 27 are centered. The central depression would be omitted to produce a flat head. The distance separating shoulders 29 must be controlled to predetermined tolerances (e.g., 0.005 inch). This is easily and economically accomplished by the hobbing method described above because shoulder 15 acts as a stop that accurately positions hobs 18 and 19 relative to each other at the end of the press stroke. Projections 26 and 27 extend beyond shoulders 29 and are centered on the longitudinal centroidal axis of member 10, and shoulders 29 are in planes perpendicular to that axis.

A holder 33 for punch member 10 has a cylindrical body 34 with a circular opening 35 passing longitudinally through its center from one end to the other. Opening 35 includes at one end an enlarged circular chamber 36 which defines a ledge 37 on the interior of holder 33 surrounding the small portion of the opening. Opening 35 is chamfered at 38 to provide clearance for large projections. Punch member 10 is inserted into chamber 36 with one shoulder 29 abutting ledge 37 and the opposite shoulder 29 and its associated projection 27 extending beyond the end of holder 33. Projection 26 extends into opening 35. A relatively tight fit exists between body portion 28 and chamber 36. Opening 35 also facilitates removal of punch member 10.

Punch member 10 is secured in holder 33 by a threaded set screw member 40 passing through a transverse tapped hole 41 which communicates with chamber 36. The end 42 of set screw member 40 extends into slot 25 and bears against punch member 10, securely anchoring punch member 10 in holder 33. Holder 33 is held in a conventional chuck (not illustrated) of a heading machine with set screw 40 exposed. When the punch projection being used to head fasteners wears out, it can be replaced merely by loosening set screw 40 and reversing the ends of punch member 10, when both punch projections on member 10 are identical. Similarly, the type of recess 11 being punched can be changed by loosening set screw 40 and reversing the ends of punch member 10 when the punch projections on member 10 are different.

It has thus been shown that by the practice of this invention a double-ended heading punch can be produced by a method that saves expensive tool steel, and reduces labor and machine utilization costs. There is no loss in variety of production capability even though fewer of these double-ended punches are kept in inventory.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. The method of making a double-ended punch that produces a driving-tool receiving recess in the end of a metal blank by a single blow delivered at room temperature, comprising the steps of:

(a) forming a steel right circular cylindrical rod having identical pointed conical ends centered on the longitudinal centroidal axis thereof;

(b) inserting each of said pointed ends into the forming cavity of a separate hob having the shape of a driving-tool receiving recess;

(c) holding said rod and said hobs in longitudinal alignment in a cylindrical hole in a metal support, with one end of one of said hobs extending beyond said support;

(d) simultaneously pressing both of said hobs against said pointed ends so as to produce a double-ended punch by a single press stroke; and (e) removing said hobs from said ends; centerless grinding the outside of said cylindrical punch; and heat treating said punch.

2. The invention defined in claim 1, further comprising accurately controlling the distance between the ends of said punch by moving said hobs toward each other until said metal support prevents further travel of said hobs toward each other.

* * * * *